US005567250A

United States Patent [19]

Akamatsu et al.

[11] Patent Number: 5,567,250

[45] Date of Patent: Oct. 22, 1996

[54] THIN STEEL SHEET HAVING EXCELLENT STRETCH-FLANGE ABILITY AND PROCESS FOR PRODUCING THE SAME

[75] Inventors: Satoshi Akamatsu; Yoshikazu Matsumura, both of Futtsu, Japan

[73] Assignee: Nippon Steel Corporation, Tokyo, Japan

[21] Appl. No.: 356,280

[22] PCT Filed: Apr. 26, 1994

[86] PCT No.: PCT/JP94/00699

§ 371 Date: Dec. 20, 1994

§ 102(e) Date: Dec. 20, 1994

[87] PCT Pub. No.: WO94/25635

PCT Pub. Date: Nov. 10, 1994

[30] Foreign Application Priority Data

Apr. 26, 1993 [JP] Japan ..... 5-099891

[51] Int. Cl.[6] ..... E21D 8/04

[52] U.S. Cl. ..... 148/320; 148/661; 148/541

[58] Field of Search ..... 148/320, 541, 148/601, 657, 661

[56] References Cited

FOREIGN PATENT DOCUMENTS 295500 12/1988 European Pat. Off. ..... 148/320

673445 3/1994 Japan ..... 148/541

*Primary Examiner*—Deborah Yee

*Attorney, Agent, or Firm*—Kenyon & Kenyon

[57] ABSTRACT

A thin steel sheet having a structure comprising at least one member selected from a transgranular acicular ferrite and a bainite having a packet size of 30 to 300 μm, in a proportion of not less than 95% of the structure, is produced by subjecting a steel comprising, in terms of % by weight, 0.01 to 0.20% of C, 0.005 to 1.5% of Si, 0.05 to 1.5% of Mn and not more than 0.03% of S and optionally 0.0005 to 0.0100% of Ca or 0.005 to 0,050% of REM with the balance consisting of Fe and unavoidable impurities to continuous casting into a thin cast strip having a casting thickness in the range of from 0.5 to 5 mm, cooling the thin cast strip from the temperature range of from the casting temperature to 900° C. to the temperature range of from 650° to 400° C. at an average cooling rate of not less than V (°C./sec) represented by the following formula (1); and coiling the cooled strip at a temperature of not more than 650° C.:

$$\log V \geqq 0.5-0.8 \log Ceq \ (°C./sec) \quad (1)$$

wherein Ceq=C+0.2 Mn.

6 Claims, 1 Drawing Sheet

THIN STEEL SHEET HAVING EXCELLENT STRETCH-FLANGE ABILITY AND PROCESS FOR PRODUCING THE SAME

TECHNICAL FIELD

The present invention relates to an as-cast thin steel sheet having a casting thickness of 0.5 to 5 mm and particularly to a thin steel sheet having an excellent stretch-flange ability and a process for producing the same.

BACKGROUND ART

At the present time, a thin steel sheet having a sheet thickness of 1.4 to 5 mm is produced as a hot-rolled steel sheet by using, as a starting material, a slab having a thickness exceeding 200 mm and subjecting the material to hot rolling. In the above current process, the basis of the technique for formation of an intended structure in the present saturation, that is, the regulation of the structure, is to increase the number of nucleation sites in transformation by causing recrystallization in the material in the step of hot-rolling the material to refine a coarse austenitic structure to increase the intergranular area or by rolling the material in a non-recrystallization region to introduce a deformation zone (a zone where the dislocation density is locally high) or by using other means, thereby enabling the structure of ferrite or the like, produced during cooling, to be refined.

Incidentally, in the conventional process, the grain diameter of the austenite before transformation is not more than 20 μm, and also in the structure obtained by transformation, the grain diameter of the ferrite, for example, is not more than 20 μm.

One of the hot-rolled steel sheets developed in the current process, which is a material required formability after punching (this material being used in, for example, strengthening components (members, wheels, etc.) of automobiles) is a high-strength hot-rolled steel sheet having an excellent stretch-flange ability (enlargeability). Such a steel sheet should have both a high strength as a strengthening member and workability. Up to now, high-strength steel sheets having a strength of up to 60 to 70 kgf/mm$^2$ have been developed. As disclosed in, for example, Japanese Unexamined Patent Publication (Kokai) Nos. 61-19733 and 1-162723, the steel sheets have a composite structure comprising a fine ferrite and a fine (in terms of packet size) low-temperature transformation phase (a fine pearlite, bainite or temper martensite). The term "packet" used herein is intended to mean a group of small units of a low-temperature transformation phase comprising a group of similar grain orientations which are identified by etching or the like. It is known that the local ductility, such as stretch-flange ability, is generally lowered when a phase having a hardness much greater than ferrite, such as cementite or martensite of large size, occupies, and attention has been paid particularly to homogenization and refinement (to not more than about 20 μm) of the structure.

On the other hand, advances in casting techniques in recent years have enabling a thin cast strip having a thickness corresponding to that of the hot-rolled steel sheet to be produced by a twin roll casting process or the like. Since hot rolling used in the prior art can be completely omitted, this process has been studied as a cost-effective and energy-saving process mainly for producing a material for a cold-rolled steel sheet subjected to cold rolling/annealing. However, when the thin cast strip, as such, is regarded as a material corresponding to a hot-rolled steel sheet, since the austenite grain diameter is as large as about 1000 μm, the structure mainly composed of ferrite also is generally likely to coarsen significantly. For this reason, the properties of the thin cast strip have hardly been studied.

The present inventors have aimed at the above thin cast strip and made studies with a view to producing a steel sheet having an excellent toughness or strength-ductility balance from the thin cast strip. As a result, they have succeeded in forming a fine bainite or Widmanstätten ferrite structure by cooling the material in an austenite region, i.e., in the temperature range of from 900° to 400° C., at a cooling rate of 1° to 30° C./sec to precipitate MnS, TiN, etc. which are utilized as nuclei in transgranular transformation, then conducting cooling in the temperature range of from 900° to 600° C. at a cooling rate of not less than 10° C./sec to form the fine bainite or Widmanstätten ferrite structure composed mainly of the above precipitates. This was disclosed by the present inventors in Japanese Unexamined Patent Publication (Kokai) Nos. 2-236224 and 2-236228 and the like.

In the above-described thin cast strip, particularly Ti and B were added as a steel composition to form a precipitate of TiO, $Ti_2O_3$, TiN or the like or a precipitate of BN, $Fe_{23}(C,B)_6$ or the like, which regulated ferrite produced in grain boundaries and, at the same time, contributed to nucleation of ferrite transformation, so that a fine ferrite or bainite structure could be formed.

Since, however, the above precipitates, which are utilized as transformation nuclei, are precipitated in an austenite region, they are likely to coarsen, so that the stretch-flange ability of the steel sheet with these hard precipitates dispersed therein is generally poor. For this reason, no detailed study has been made on techniques for improving the stretch-flange ability in the above-described thin steel sheet.

Accordingly, the present inventors have made new studies with a view to imparting stretch-flange ability to a steel sheet formed from the above-described thin cast strip.

The austenitic structure of hot-rolled steel sheets produced by the conventional process is so fine that it is generally difficult to impart stretch-flange ability to them. Specifically, the fine structure of the hot-rolled steel sheets unavoidably causes ferrite to be produced during cooling after hot rolling, which generally makes it difficult to provide a structure consisting of a low-temperature transformation phase alone, such as bainite, which is advantageous for the stretch-flange ability. For example, in the above-described Japanese Unexamined Patent Publication (Kokai) No. 61-19733, a low temperature transformation phase occupying not less than 50% of the structure is obtained with difficulty by adopting means such as use of somewhat high temperature in finish hot rolling to avoid refinement of austenitic structure and close control of cooling conditions. Further, Japanese Unexamined Patent Publication (Kokai) No. 1-162723 proposes the in situ formation of an intended structure which applies a high load on the process. Specifically, in this process, even after a martensite phase is formed by annealing in a two-phase region after hot rolling, tempering is carried out for the purpose of reducing a difference in hardness between the martensite and the ferrite.

The present inventors have made studies with a view to providing a thin steel sheet having an excellent stretch-flange ability and consisting of a low-temperature transformation phase alone through a smaller number of process steps than the conventional process and, as a result, have found that this object can be attained by cooling a steel sheet formed from the above thin cast strip at a particular cooling rate.

The above steel sheet is made on the premise that it is applied to strengthening members, and materials having a tensile strength of not less than 35 kgf/mm$^2$ are contemplated.

Specifically, an object of the present invention is to provide a thin steel sheet having an excellent stretch-flange ability through a smaller number of process steps than the conventional process.

Another object of the present invention is to provide a thin steel sheet having both high strength and stretch-flange ability.

A further object of the present invention is to impart an excellent stretch-flange ability to a steel sheet formed from a thin cast strip.

CONSTITUTION OF INVENTION

The present inventors have made various studies on stretch-flange ability with a view to attaining the above-described objects and, as a result, have noticed that the austenitic structure of an as-cast thin steel strip, which has hitherto been ignored in the art, is very advantageous for the formation of a low-temperature transformation phase indispensable to a structure capable of imparting an excellent stretch-flange ability to the steel sheet.

Further, they have found that solidification of a molten steel followed by cooling, in a region where austenite is transformed to ferrite, at a predetermined cooling rate depending upon the compositions enables a desired very homogeneous low-temperature transformation phase, that is, a structure consisting of transgranular acicular ferrite, bainite, etc. alone, to be provided.

Specifically, the present inventors have succeeded in the formation of a structure consisting of a low-temperature transformation phase alone by adding no carbonitride forming element such as Ti and cooling as-cast solidified coarse austenite grains at a predetermined cooling rate to prevent the formation of intergranular ferrite and eliminate the precipitate, and a thin steel sheet having a very good stretch-flange ability while enjoying a high strength could be provided, for the first time, by virtue of the above structure.

The present invention has been completed based on the above finding, and the subject matter of the present invention is as follows.

The thin steel sheet according to the present invention is characterized by comprising, in terms of % by weight, 0.01 to 0.20% of C, 0.005 to 1.5% of Si, 0.05 to 1.5% of Mn and not more than 0.030% of S and optionally 0.0005 to 0.0100% of Ca and 0.005 to 0.050% of REM including Y with the balance consisting of Fe and unavoidable impurities, said thin steel sheet having a structure comprising at least one member selected from a transgranular acicular ferrite and a bainite having a packet size of 30 to 300 μm in a proportion of not less than 95% of the structure and a sheet thickness in the range of from 0.5 to 5 mm.

The process for producing the above-described thin steel sheet is characterized by comprising the steps of: subjecting a steel comprising the above compositions to continuous casting into a thin cast strip having a casting thickness in the range of from 0.5 to 5 mm; cooling said thin cast strip from the temperature range of from the casting temperature to 900° C. to the temperature range of from 650° to 400° C. at an average cooling rate of not less than V (°C./sec) represented by the following formula (1) specified by C and Mn; and coiling the cooled strip at a temperature of not more than 650° C.:

$$\log V \geqq 0.5-0.8 \log Ceq \ (°C./sec) \quad (1)$$

wherein Ceq=C+0.2 Mn.

In this case, the material may be lightly rolled in an in-line manner with a reduction ratio of not more than 20% for the purpose of breaking shrinkage cavities in the thin cast strip.

BEST MODE FOR CARRYING OUT THE INVENTION

Figure 1:
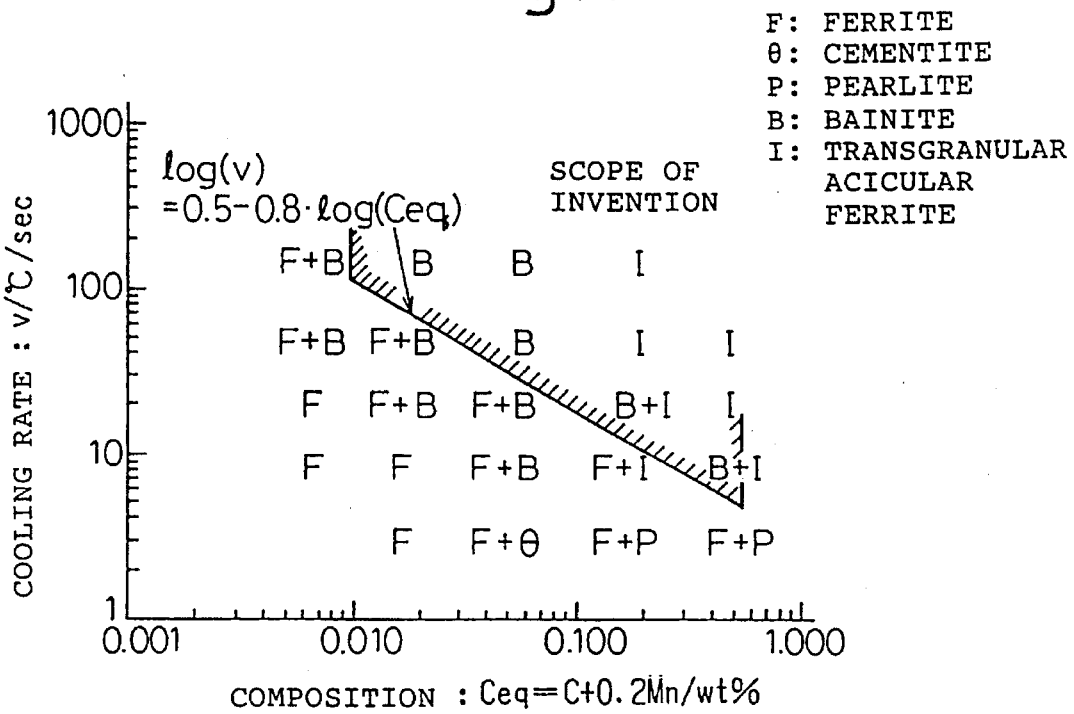
FIG. 1 is a diagram showing the effect of steel composition and cooling rate on a microstructure.

The best mode for carrying out the invention will now be described in detail.

At the outset, the reason for the limitations on the compositions in the present invention will be described.

C is the most important element for forming the structure of the steel and, at the same time, determining the strength of the steel. When the C content is less than 0.01% (all "%" in connection with the compositions being hereinafter "% by weight"), the formation of ferrite is unavoidable even when the cooling rate is increased. Further, in this case, a strength of not less than 35 kgf/mm$^2$ cannot be imparted. On the other hand, when the C content exceeds 0.2%, the deterioration of ductility is remarkable and the weldability also is deteriorated. For this reason, the C content is limited to 0.01 to 0.20%.

Si is important as a reinforcing element for the steel. When the Si content exceeds 1.5%, the effect is saturated and the pickleability is deteriorated, while when it is less than 0.005%, the usual effect of the addition of Si cannot be attained, so that the Si content is limited to 0.005 to 1.5%.

Mn is an element which contributes to an improvement in strength and ductility of the steel. When the amount of Mn added exceeds 1.5%, the cost becomes high, while when it is less than 0.05%, the usual effect of the addition of Si cannot be attained, so that the Mn content is limited to 0.05 to 1.5%.

S is an unavoidable impurity element which deteriorates the stretch-flange ability through sulfide inclusions.

Therefore, the lower the S content, the better the results. For this reason, the upper limit is 0,030%.

A reduction in S, a reduction in sulfide inclusions and spheroidizing of the inclusions are useful for improving the stretch-flange ability. Ca or REM (lanthanide elements including Y) is useful for the spheroidization.

Therefore, if necessary, Ca and REM may be added in respective amounts in the range of from 0.0005 to 0.0100% and in the range of from 0.0050 to 0.050%. When the amount of Ca or REM added is less than the above range, the effect attained by spheroidizing is small. On the other hand, when it exceeds the above range, the effect attained by spheroidizing is saturated and a contrary effect occurs because the amount of inclusions is rather increased.

In the present invention, although there is no limitation on P and N, P and N are elements included as unavoidable impurities in the steel and in the steel of the present invention, the contents of both the elements are limited to not more than 0.02%. Al is unavoidably contained as a deoxidizing element in an amount of not more than 0.1%.

On the other hand, when scrap is used as a main raw material, there is a possibility that tramp elements, such as Cu, Sn, Cr and Ni, are included in steel compositions. The present invention, however, is not restricted by these tramp elements. In this case, the element content is not more than 0.5% for Cu, is not more than 0.3% for Ni, is not more than 0.3% for Cr and is not more than 0.1% for Sn.

The structure of the steel of the present invention will now be described.

In the steel of the present invention, the structure is such that a bainite having a packet size of 30 to 300 μm, a transgranular acicular ferrite or a mixture thereof (the structure being varied depending upon the amount of C and Fin added and the cooling rate) occupies not less than 95% of the structure.

When the C and Mn contents are low, the structure is likely to be composed mainly of bainite. On the other hand, when these contents are high, the structure is likely to be composed mainly of acicular ferrite.

Figure 2:
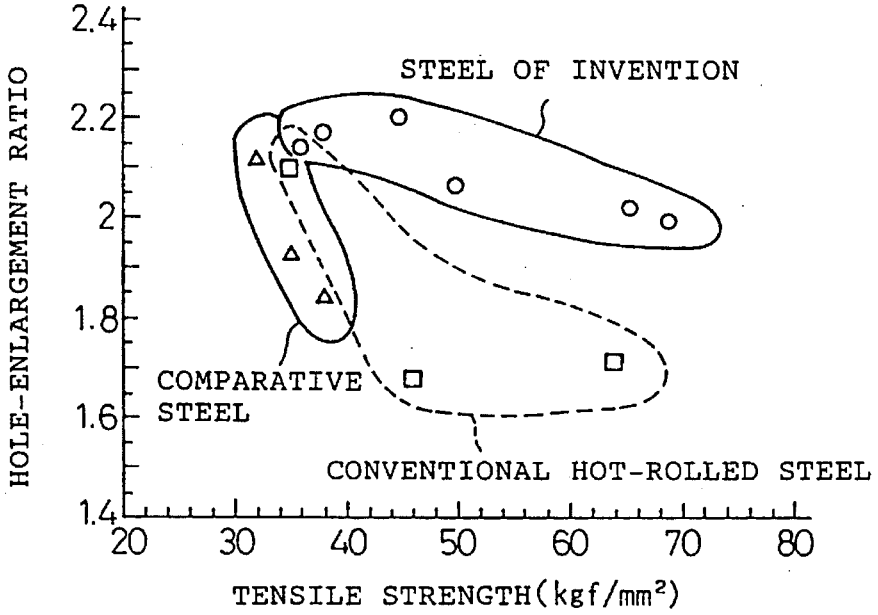
FIG. 2 is a diagram showing the relationship between tensile strength and hole-enlargement ratio.

AS shown in FIG. 2, which was prepared based on the results of examples which will be described later, the steel having the above-described structure has a unique mechanical property in that the hole-enlargeability (a measure of stretch-flange ability) is always kept constant and is highly independent of the magnitude of the tensile strength (strength).

The above-described steel is produced under the following production conditions.

What is most important to the formation of the structure and the quality in the present invention is that the coarse austenite structure provided by casting (for example, twin-roll casting), as such, is brought into a ferrite transformation region. Specifically, as opposed to the conventional hot rolling process, it is unfavorable that rolling is carried out with a high reduction ratio in an austenite region, which causes austenite grains to be refined by recrystallization or the like. For this reason, it is necessary for the cast steel strip to already have a thickness corresponding to the thickness of the product steel sheet. However, when the casting thickness exceeds 5 mm, the productivity is lowered remarkably, while when the casting thickness is less than 0.5 mm, the stability of casting cannot be ensured. For this reason, in the present invention, the casting thickness, that is, the thickness of the steel sheet, is limited to 0.5 to 5 mm. In the present invention, there is no need of carrying out rolling for the above reason. However, the effect of the present invention is not inhibited by rolling the steel sheet with a low reduction ratio of not more than 20% in an in-line manner for the purpose of regulating the surface roughness and the crown of the cast slab or breaking shrinkage cavities at the center portion of the sheet thickness caused by casting.

As described above, cooling conditions suitable for bringing the casting austenitic structure per se to a ferrite transformation region were determined based on the following experimental results.

Molten steels with varied C, Si and Mn contents were prepared by the vacuum melt process, cast into 3.2 mm-thick sheets by twin-roll casting, cooled from 950° to 600° C. at various cooling rates and then subjected to an examination of the microstructure. The results of the examination of the resultant microstructure are shown in FIG. 1. In this drawing, with respect to symbols used for representing the microstructure, F represents coarse ferrite, θ cementite, P pearlite, B bainite and I fine acicular ferrite (i.e., ferrite having an aspect ratio of not less than 1: 5) produced transgranularly from austenite, and when two symbols are described together, the structure comprises a mixture of the two structures represented by the respective symbols. The hatched region in the drawing represents the conditions falling within the scope of the present invention.

More specifically, when cooling is carried out at a cooling rate (°C./sec) V determined by the following formula (1), the resultant microstructure comprises bainite, transgranular acicular ferrite or a mixed structure thereof and produces neither fine ferrite having a grain diameter of not more than 20 μm (granular polygonal ferrite), which is necessarily contained in the current hot-rolled materials, nor coarse ferrite.

$$\log V = 0.5 - 0.8 \log Ceq \quad (1)$$

wherein Ceq=C+0.2 Mn (in % by weight).

The above-described formula (1) depends upon compositions, and for example, the SS400 class of steel sheets can form the structure of the present invention even when the cooling rate is not higher than 10° C./sec.

Further, although the bainite in the steel of the present invention has a packet size of 30 μm or more, which is larger than that in the bainite in the conventional steels, the structure thereof is macroscopically very homogeneous. Further, the transgranular acicular ferrite also has a very homogeneous structure. These two phases formed at a low-temperature occupy not less than 95% of the structure in terms of the total content. Thus, according to the present invention, a low-temperature transformation phase advantageous for the stretch-flange ability can be wholly provided by causing transformation at a certain or higher cooling rate which does not form coarse ferrite.

Similarly, from FIG. 1, it is apparent that all the steel sheets cooled under conditions outside the scope of the invention have a mixed structure in which coarse ferrite is also present.

For this reason, as shown in FIG. 2, in these steel sheets, the stretch-flange ability deteriorates, particularly with increasing strength.

As described above, the structure of the steel of the present invention is very different from that of the current hot-rolled materials and cannot be provided by the conventional process in which ferrite transformation occurs from austenite refined by hot rolling. It is often found in a molten metal portion during welding. Production conditions under which the structure of a steel strip is wholly homogeneous have been newly found by the present inventors.

In the present invention, the cooling initiation temperature should be above a temperature at which the ferrite transformation begins, so that it is limited to 900° C. or above. On the other hand, the coiling temperature is limited to not higher than 650° C. because an excessively high coiling temperature causes supercooling for transformation by cooling to become unattainable. The lower limit of the coiling temperature is not particularly limited. However, it is preferably 400° C. or above because if the alloy element content is high, there occur problems including that there is a possibility of under the Ms point (martensite start temperature) when the material is excessively cooled and that the shape is broken.

EXAMPLES

Steels comprising chemical compositions specified in Table 1 were melted. Thereafter, steels A to H were cast into 2.7 mm-thick thin strips by twin-roll casting and then cooled and coiled as specified in the same table. In this case, steels A to F are the steels of the present invention, and conditions thereof fall within the scope of the present invention. Steels G, H and I are comparative steels because the C content in the case of steel G, the cooling rate in the case of steel H and the cooling rate and coiling temperature in the case of steel I are outside the scope of the present invention. On the other hand, steels J to L as conventional steels were cast into 230 mm-thick slabs by the conventional continuous casting process, subjected to conventional hot rolling at a reheating temperature of 1100° C. to provide hot-rolled steel sheets having thickness of 2.6 mm.

Then, the above steel strips were pickled and cut in a sheet cutting line to provide cut sheets. In this case, temper rolling was carried out with a reduction ratio of 1%. Thereafter, this sample was subjected to observation of structure and quality test.

The results of observation of the section in the direction of sheet thickness under an optical microscope are also shown in Table 1 (right column). The symbols used herein respectively have the same meanings as those in FIG. 1. As is apparent from these results, steels A to F produced by the process of the present invention consisted of a low-temperature transformation phase such as bainite or transgranular acicular ferrite, whereas steels G to I outside the scope of the present invention with respect to compositions or cooling conditions comprised a mixed structure comprising a pro-eutectoid ferrite besides the low-temperature transformation phase although they are in a thin cast strip form. Steels J to L as the conventional hot-rolled materials had a small grain diameter of not more than 20 μm. They, however, had a mixed structure comprising a pro-eutectoid ferrite besides the low temperature transformation phase. Further, these hot-rolled materials generally have a structure somewhat elongated in the rolling direction. By contrast, since the steels of the present invention do not originally experience rolling, they macroscopically have an isotropic structure, which is one of the features of the present invention.

A tensile test and a hole-enlargement test were carried out as the quality test. The tensile test was carried out according to JIS Z2201 using a No. 5 specimen. The hole-enlargement test was carried out by a method wherein a shear hole having a diameter of 20 mm formed by punching is enlarged by a conical punch with flash outward to determine the hole diameter at the time when a crack has been passed through the sheet thickness. This measured value was divided by the original hole diameter (20 mm) to determine the hole-enlargement ratio.

TABLE 1

| | Compositions of steel (wt. %) | | | | | v (°C./sec) determined by formula | Cooling initiation temp. | Cooling rate (°C./sec) | Coiling temp. | Structure | |
|---|---|---|---|---|---|---|---|---|---|---|---|
| | C | Si | Mn | S | Other elements | (1) | (°C.) | | (°C.) | | Remarks |
| Steel A | 0.03 | 0.01 | 0.18 | 0.008 | | 28 | 1030 | 48 | 450 | B | Steel of invention |
| Steel B | 0.04 | 0.01 | 0.15 | 0.005 | Cu: 0.10, Sn: 0.03 | 27 | 960 | 35 | 530 | B | Steel of invention |
| Steel C | 0.05 | 0.03 | 0.44 | 0.011 | | 15 | 930 | 24 | 600 | I | Steel of invention |
| Steel D | 0.12 | 0.20 | 0.66 | 0.007 | Cu: 0.05, Cr: 0.08 | 9.5 | 930 | 17 | 600 | I | Steel of invention |
| Steel E | 0.16 | 0.72 | 1.20 | 0.005 | | 6.6 | 910 | 10 | 620 | I | Steel of invention |
| Steel F | 0.17 | 0.10 | 1.40 | 0.023 | | 6.0 | 1050 | 8 | 580 | I | Steel of invention |
| Steel G | 0.003 | 0.02 | 0.13 | 0.006 | | 53 | 960 | 60 | 520 | F + B | Comparative steel |
| Steel H | 0.02 | 0.03 | 0.12 | 0.012 | | 38 | 930 | 20 | 500 | F + B | Comparative steel |
| Steel I | 0.13 | 0.25 | 0.70 | 0.007 | | 9.1 | 910 | 6 (Air cooling | 720 | F + P | Comparative steel |
| Steel J | 0.05 | 0.02 | 0.21 | 0.008 | | — | 910 | — | 620 | F + θ | Conventional hot-rolled material |
| Steel K | 0.12 | 0.08 | 0.45 | 0.010 | | — | 870 | — | 570 | F + P | COnventional hot-rolled material |
| Steel L | 0.12 | 0.86 | 1.13 | 0.006 | Ca: 0.0028 | — | 870 | — | 410 | F + B | Conventional hot-rolled material |

(Note)
(1) Cooling initation temperature: finish termination temperature
(2) Underlined portion: outside the scope of invention
(3) Symbols for representing structure
F: Ferrite, θ: Cementite, P: Pearlite, B: Bainite, and I: Transgranular acicular ferrite The results of the quality test are given in Table 2. As apparent from the table, steels A to F, which are the steels of the present invention, are superior to steels J to L produced through the conventional hot rolling process in the hole-enlargement ratio as a measure of the stretch-flange ability although they are somewhat inferior in elongation on the same strength level. On the other hand, steel G, which is a comparative steel although it is a thin cast strip, lacks in strength because the C content is outside the scope of the present invention. Steels H and I are outside the scope of the present invention with respect to the production conditions and contain ferrite, so that the hole-enlargement ratios also are not particularly excellent. FIG. 2 is a diagram showing the strength-enlargement ratio balance. In the conventional steels and the comparative steels, the hole-enlargement ratio falls with increasing strength, whereas in the steels of the present invention, the hole-enlargement ratio remained on the level of not less than 2 until the tensile strength reaches about 70 kgf/mm$^2$. From this Figure, it is apparent that the superiority of the steel of the present invention increases with increasing the strength of the steel sheet.

TABLE 2

| | Strength at yield point (kgf/mm²) | Tensile strength (kgf/mm²) | Elon-gation (%) | En-large ratio | Remarks |
|---|---|---|---|---|---|
| Steel A | 28.2 | 38.1 | 37 | 2.17 | Steel of invention |
| Steel B | 26.4 | 36.4 | 40 | 2.14 | Steel of invention |
| Steel C | 36.1 | 44.9 | 30 | 2.20 | Steel of invention |
| Steel D | 33.9 | 50.0 | 26 | 2.06 | Steel of invention |
| Steel E | 46.0 | 68.2 | 22 | 2.01 | Steel of invention |
| Steel F | 44.1 | 62.5 | 24 | 2.05 | Steel of invention |
| Steel G | 23.1 | 32.3 | 35 | 2.12 | Comparative steel |
| Steel H | 24.8 | 35.2 | 36 | 1.93 | Comparative steel |
| Steel I | 28.3 | 37.8 | 32 | 1.84 | Comparative steel |
| Steel J | 22.0 | 35.2 | 45 | 2.10 | Conventional hot-rolled material |
| Steel K | 30.4 | 45.9 | 38 | 1.68 | Conventional hot-rolled material |
| Steel L | 42.2 | 64.3 | 31 | 1.71 | Conventional hot-rolled material |

INDUSTRIAL APPLICABILITY

As is apparent from the foregoing detailed description, according to the present invention, hot-rolled steel sheets having an excellent stretch-flange ability, which have hitherto been produced through the conventional hot rolling process by specifying various compositions and hot rolling conditions, can be produced in a cost effective and relatively easy manner by twin rolling casting wherein hot rolling is omitted. Further, according to the process of the present invention, it is basically unnecessary to carry out rolling, so that none of the surface and edge defects attributable to rolling in the conventional process, such as scab and edge crack, occur in the process of the present invention. This is considered advantageous especially when thin steel sheets are produced using as a main raw material scrap containing tramp elements causative of surface defects, such as Cu and Sn. It is a matter of course that the steel of the present invention can be used not only as a material necessary to have stretch-flange ability but also as a material necessary to have strength which can be satisfied by the steel of the present invention.

We claim:

1. A thin steel sheet having an excellent stretch-flange ability, comprising, in terms of % by weight, 0.01 to 0.20% of C, 0.005 to 1.5% of Si, 0.05 to 1.5% of Mn and not more than 0.03% of S with the balance consisting of Fe and unavoidable impurities, said thin steel sheet having a structure comprising at least one member selected from a transgranular acicular ferrite and a bainite having a packet size of 30 to 300 μm in a proportion of not less than 95% of the structure and a sheet thickness in the range of from 0.5 to 5 mm.

2. A thin steel sheet according to claim 1, which further comprises, in terms of % by weight, 0.0005 to 0.0100% of Ca or 0.005 to 0.050% of REM.

3. A process for producing a thin steel sheet having an excellent stretch-flange ability, comprising the steps of: subjecting a steel comprising, in terms of % by weight, 0.01 to 0.20% of C, 0.005 to 1.5% of Si, 0.05 to 1.5% of Mn and not more than 0.03% of S with the balance consisting of Fe and unavoidable impurities, to continuous casting into a thin cast strip having a casting thickness in the range of from 0.5 to 5 mm; cooling said thin cast strip from the temperature range of from the casting temperature to 900° C. to a temperature of not higher than 650° C. at an average cooling rate of not less than V (°C./sec) represented by the following formula (1); and coiling the cooled strip at a temperature of not more than 650° C.:

$$\log V \leqq 0.5-0.8 \log Ceq \ (°C./sec) \quad (1)$$

wherein Ceq=C+0.2 Mn.

4. The process according to claim 3, wherein said steel further comprises, in terms % by weight, 0.0005 to 0.0100% of Ca or 0.005 to 0.050% of REM.

5. The process according to claim 3 wherein rolling is carried out with a reduction ratio of not more than 20% between casting and coiling.

6. The process according to claim 3, wherein said steel further comprises, in terms % by weight, 0.0005 to 0.0100% of Ca or 0.005 to 0.050 of REM and rolling is carried out with a reduction ratio of not more than 20% between casting and coiling.

* * * * *